United States Patent [19]

Fromson

[11] 4,014,756

[45] Mar. 29, 1977

[54] PROCESS FOR MAKING METAL POWDERS

[76] Inventor: Howard A. Fromson, 15 Rogues Ridge Road, Weston, Conn. 06880

[22] Filed: Jan. 21, 1976

[21] Appl. No.: 651,020

[52] U.S. Cl. ..... 204/10; 204/208

[51] Int. Cl.[2] ..... C25D 1/00; C25D 1/20

[58] Field of Search ..... 204/10, 281, 42, 208, 204/216

[56] References Cited

UNITED STATES PATENTS

| | | | |
|---|---|---|---|
| 2,898,490 | 8/1959 | Damon | 204/42 |
| 3,397,133 | 8/1968 | Sooryn | 204/10 |
| 3,419,901 | 12/1968 | Nordblom | 204/10 |
| 3,577,330 | 5/1971 | Knapp | 204/10 |
| 3,582,476 | 6/1971 | Knisley | 204/11 |
| 3,860,509 | 1/1975 | Emmett, Jr. | 204/281 |
| 3,929,594 | 12/1975 | Fromson | 204/42 |

*Primary Examiner*—T. M. Tufariello

*Attorney, Agent, or Firm*—Burgess, Dinklage & Sprung

[57] ABSTRACT

Metal powders are made by electrolytically depositing discrete metal particles in the pores of a porous oxide surface of an anodized aluminum article followed by liberation of the metal particles by contact with a substance that will attack, e.g. dissolve, the oxide surface but not the metal particles.

5 Claims, 14 Drawing Figures

Cr 300 X 30 SEC.

Cr 1000 X 30 SEC.

Cr 3000 X 30 SEC.

Cr 300 X 150 SEC.

Cr 1000 X 150 SEC.

Cr 3000 X 150 SEC.

Cu 300 X 30 SEC.

Cu 1000 X 30 SEC.

Cu 3000 X 30 SEC.

Cu 300X 60 SEC.

Cu 1000X 60 SEC.

Cu 3000X 60 SEC.

PROCESS FOR MAKING METAL POWDERS

BACKGROUND

This invention relates to a process for making metal powders by batchwise or continuously electrolytically depositing metal particles in the pores of an anodic oxide surface of an anodized aluminum article followed by liberation of the thus deposited particles from the pores.

The art of surface treating and finishing of aluminum and its alloys is a complex and well developed art as evidenced by the texts of S. Wernick entitled Surface Treatment and Finishing of Aluminum and Its Alloys, Robert Draper Ltd., Teddington, England (1956) and G. H. Kissin, Finishing of Aluminum, Reinhold Publishing Corporation, New York. It is acknowledged that electroplating on aluminum requires extraordinary treatments to gain the necessary adhesion. The most familiar techniques for plating on aluminum are the zincating and anodizing processes. In the latter case which involves the plating over an anodic oxide layer formed on an aluminum substrate, the art has directed its efforts towards producing continuous electroplated coatings.

It has now been discovered that metal particles can be made by forming a discontinuous electroplated metal phase in the pores of unsealed anodized aluminum followed by liberation of the metal particles in the pores. This provides metal powders having a large surface area which can be used, for example, in metal powder coating compositions and the like.

SUMMARY

The process of the invention for making metal powders, batchwise or continuously, includes the steps of elecrolytically depositing discrete metal particles in the pores of a porous oxide surface of an anodized aluminum article followed by liberating the metal particles from the pores by contacting the anodized/plated article with a substance such as caustic alkali that will attack the porous oxide surface but not the metal particle.

In a preferred embodiment aluminum or aluminum surfaced webs are continously elecrolytically anodized and discontinuously plated by continuously passing the web through an anodizing cell having therein a cathode connected to a source of direct current, continuously passing the web from the anodizing cell into a cathodic contact cell having therein a platable metal anode connected to the source of direct current, introducing anodizing direct current into the web in the contact cell, the web having an anodized oxide coating formed thereon in the anodizing cell before entering the contact cell, and depositing particles of the platable metal in the pores of the oxide coating in the contact cell.

DESCRIPTION OF THE DRAWINGS

The present invention will be more fully understood from the following description taken in conjunction with the accompanying drawings wherein:

FIG. 13 is an enlarged cross-sectional view depicting a metal particle in a pore of the anodic oxide layer and extending above the surface thereof.

DESCRIPTION

Figure 1:
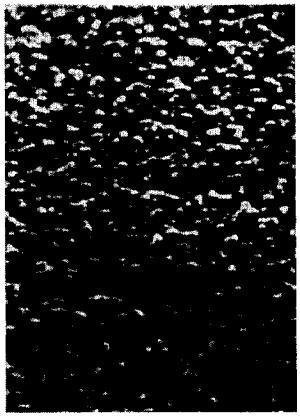
FIGS. 1–6 are photomicrographs showing submicron size chromium particles electrolytically deposited in the pores of an unsealed anodized aluminum surface.
Figure 2:
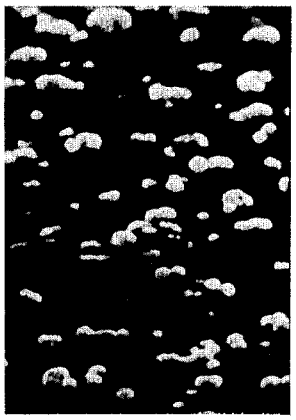
Figure 3:
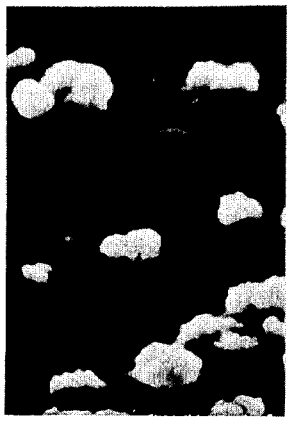
Figure 4:
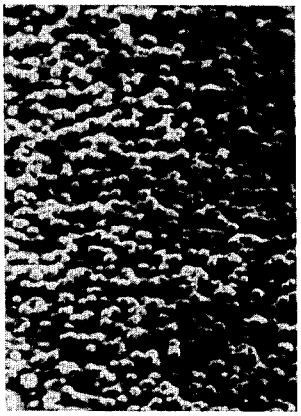
Figure 5:
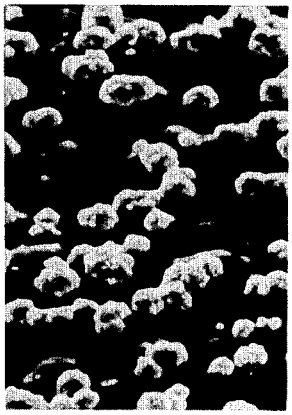
Figure 6:
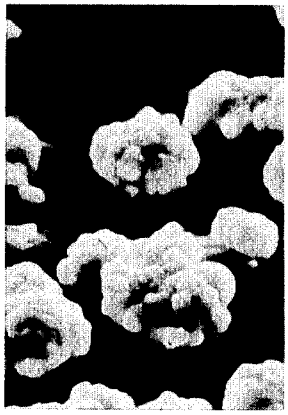
Figure 7:
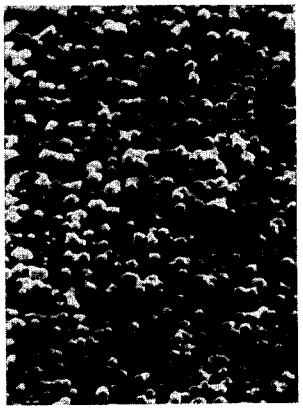
FIGS. 7–13 are photomicrographs showing submicron size copper particles electrolytically deposited in the pores of an unsealed anodized aluminum surface.
Figure 8:
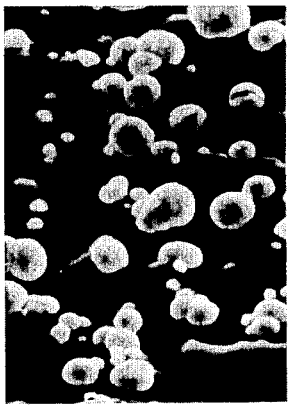
Figure 9:
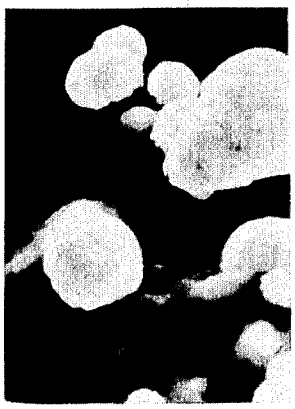
Figure 10:
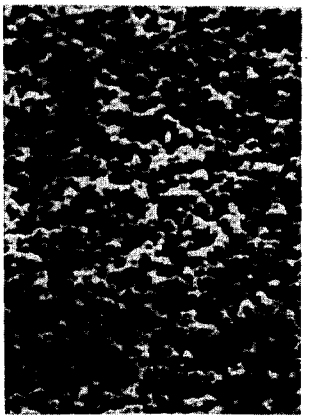
Figure 11:
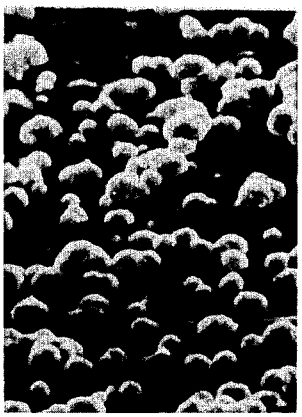
Figure 12:
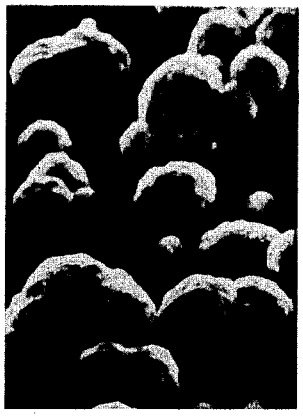

According to the present invention, micron size and smaller metal powders are made by electroplating a platable metal into the pores of an unsealed anodic oxide surface on an anodized aluminum article. The electroplating is carried out in such a way so that discrete, individual metal particles of micron size or smaller are deposited in the pores of the anodic oxide surface.

The pore size of an unsealed anodic oxide surface of an aluminum article can be made to vary in diameter and in depth by varying anodizing conditions as is well known in the art. For purposes of the present invention, it is preferred to anodize aluminum to form an unsealed anodic oxide layer having pores with a diameter in the range of about 50–300 Angstroms. There are 10,000 Angstroms in a micron which means that some submicron size metal powders can easily be formed according to the present invention and a desired size range can be attained by control of the anodizing operation.

The process of the invention can be carried out discontinuously or batchwise and is preferably carried out continuously using an aluminum web of suitable thickness which can be continuously anodized, plated, the metal particles liberated; the process can then be repeated using the same aluminum web.

The present invention, in effect, uses the pores of an anodic oxide surface or layer as the mold into which individual metal particles can be electrolytically cast in submicron size or larger. The individual particles are liberated to form the metal powder by contact with a substance that will attack, e.g., dissolve the aluminum oxide layer but not the metal particles. In other words, the electro-deposited metal particles are inert to the substance which is capable of attacking and destroying or dissolving the porous anodic oxide layer.

Suitable substances for attacking the anodic oxide layer include acids such as chrome/phosphoric acid mixtures and the like, and bases such as aqueous sodium hydroxide, potassium hydroxide, trisodium phosphate and the like.

As an example, an aluminum sheet having a thickness of one or more mills can be anodized to form an anodic oxide layer with an average thickness of about one micron with individual pore diameters of about 100 Angstroms. A platable metal such as copper or chromium is then plated into the pores of the anodic oxide layer. The plating conditions can be controlled to obtain particles of varying size. This can be done by stopping the plating operation before or as the pores become filled with plated metal or the plating operation can be allowed to continue until the plated metal particles grow and extend above the surface of the anodic oxide layer. Metal particles formed in this way are shown in FIGS. 1–12 of the drawing.

After destroying, e.g., dissolving the anodic oxide layer, metal powder formed according to the invention can be recovered in any of a number of ways, for example, by filtering, vacuum drying, with or without washing, and the like. To prevent agglomeration of the individual metal particles, the metal powder can be suspended or disbursed in a suitable liquid medium such as water or an organic liquid.

Figure 13:
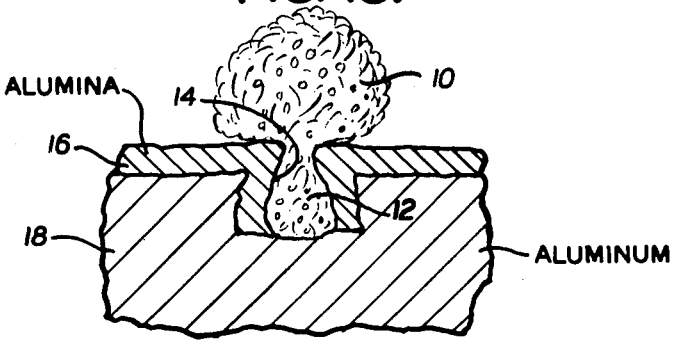

FIG. 13 shows an aluminum substrate 18 with an unsealed, porous anodic oxide layer 16 thereon. Electrolytically deposited metal particles 10 with portion 12 are in the pores 14 of the oxide layer 16. The particles 10 extend from the portion 12 above the surface of the oxide layer 16 but, as stated previously, they can be below or even with the pore opening. FIGS. 1–12 are photomicrographs obtained using an electron microscope at magnifications of 300, 1,000 and 3,000. Chromium was electrolytically deposited in these examples over a period of time of 30 seconds (FIGS. 7–9) and 60 seconds (FIGS. 10–15). In each instance, the chromium or the copper is deposited in the form of discrete metal particles in the pores of the anodic oxide layer.

A unique feature of the present invention is the electrolytic deposition of metal particles which are discrete one from the other.

Virtually any platable metal can be applied to an anodized aluminum article to form metal powders according to the present invention. Examples of suitable metals include copper, tin, zinc, silver, nickel, gold, rhodium, chromium, alloys and mixtures of the foregoing and the like.

The metal powders of the invention can be made using conventional anodizing and plating techniques but are preferably made using the continuous anodizing and plating processes described in my U.S. Pat. No. 3,865,700 issued Feb. 11, 1975, U.S. Pat. No. 3,920,525 issued Nov. 18, 1975, and No. 3,929,594 issued Dec. 30, 1975. A key factor in the plating operation is the plating time which should be selected depending on the desired size of the metal particles.

According to the process disclosed in patent No. 3,865,700, aluminum is continuously electrolytically anodized and plated by introducing anodizing direct current into the aluminum in a cathodic contact cell containing a platable metal, the aluminum having an anodized oxide coating formed thereon before entering the cell by the action of the direct current introduced in the contact cell itself. While in the contact cell the platable metal is deposited in the pores of the performed oxide coating in the form of metal particles as described herein.

Stated in different terms, aluminum web is continuously electrolytically anodized and plated by continuously passing the web through an anodizing cell having therein a cathode connected to a source of direct current continuously passing the web from the anodizing cell into a cathodic contact cell having therein a platable metal anode connected to the same source of direct current. Anodizing direct current is introduced into the web in the contact cell and the web has an anodized oxide coating formed thereon in the anodizing cell before entering the contact cell. While in the contact cell the platable metal is deposited in the pores of the oxide coating in the form of discrete metal particles as described herein.

In the process disclosed in U.S. Pat. No. 3,865,700, the aluminum web entering a cathodic contact cell already has an anodized oxide coating formed thereon before entering the cell. This makes it possible to use a platable metal for the anode of the contact cell such as a copper, nickel, zinc or the like anode. In this manner, direct current introduced into the aluminum web in the contact cell for forming an anodized oxide coating thereon before the web enters the cell, can also be used to deposit platable metals from the anode in the pores of the anodized oxide coating formed on the aluminum web before it enters the contact cell. In effect, direct current from one source is utilized for carrying out two operations, namely, forming an oxide coating on the aluminum web before it enters the contact cell and depositing platable metals in the pores of the preformed oxide coating while the aluminum web passes through the contact cell.

Figure 14:
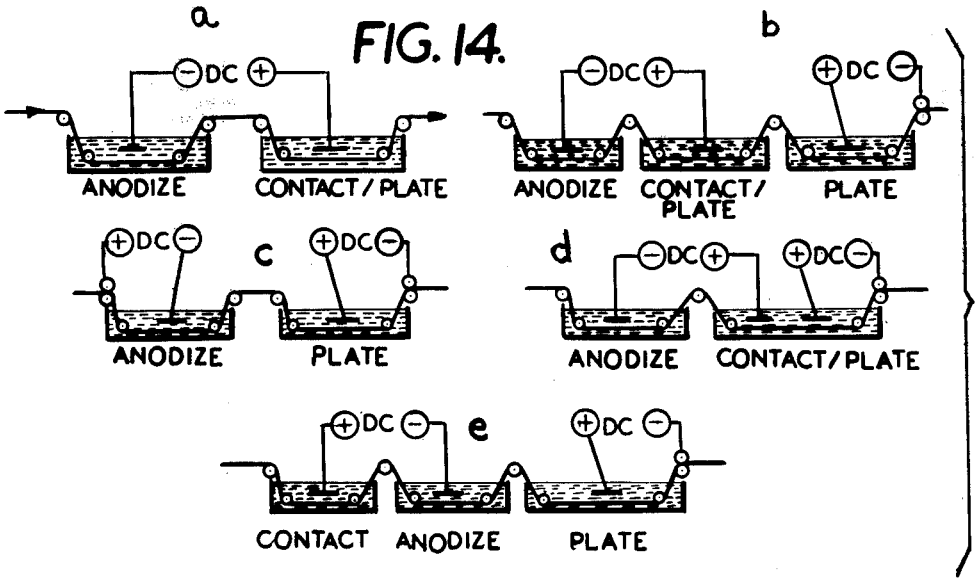
FIGS. 14*a–e* are diagrammatic representations showing several ways in which an aluminum web can be continuously anodized and plated to form metal particles according to the present invention.

FIG. 14 of the drawing shows several embodiments for continuously anodizing and plating the aluminum web for forming metal powders according to the invention. FIG. 14*a* illustrates process and apparatus described in U.S. Pat. No. 3,865,700. Here, an anodizing cell is followed by a contact cell and each is provided with suitable rollers to guide an aluminum web therethrough in the direction indicated by the arrows. Each cell includes a tank which contains an electrolyte. The anodizing cell has a cathode connected to a source of direct current as shown. The contact cell has an anode which is connected to the same source of direct current. The aluminum web continually passes through the anodizing cell and then the contact cell as illustrated. Anodizing direct current is introduced into the web in the contact cell. The web thus has an anodized oxide coating formed thereon in the anodizing cell before entering the contact cell through the action of the direct current introduced into the web in the contact cell. This same current also causes platable metal from the anode in the contact cell to be deposited in the pores of the preformed oxide coating in the form of discrete metal particles.

As is well known in the art, an aluminum web can be cleaned, de-greased or otherwise pretreated (chemically and/or mechanically) using conventional techniques before it is anodized and after being plated it can be sealed, dyed, or otherwise post-treated using conventional aluminum surface finishing techniques for example as described in my U.S. Pat. No. 3,181,461, issued May 4, 1975, and No. 3,280,734, issued Oct. 25, 1966. The web is generally passed through a continuous treating operation according to the invention utilizing conventional winding and feeding equipment.

In FIG. 14*b* an aluminum web is anodized by introducing anodizing direct current into the aluminum in the cathodic contact cell which causes the formation of an anodized oxide coating on the web before it enters the contact cell. The anodized web then passes through the plating bath and the plating current is introduced into the web via a contact roll positioned to contact the web after it leaves the plating cell. In this particular embodiment, the process is preferably started up by first threading bare aluminum web through the three treatment cells and is placed in contact with the contact roll at the exit of the plating cell. The plating current is first switched on which results in some plating on the bare aluminum web. Once the anodizing operation is initiated, the web entering the plating bath is anodized and is plated therein with discrete metal particles as described herein. This start up procedure is required when plating contact is made via a contact roll and plating is done in a separate plating cell, e.g., in the process of FIGS. 14*c* and *e* (described below). It is preferred for the process of FIGS. 14*b* and *d*.

In FIG. 14*c*, the aluminum web is anodized in an anodizing cell and the web is in contact with an electrically conductive roll prior to entering the anodizing cell. The anodized web then passes into a plating cell where the web is in contact with an electrically conductive roll after leaving the plating cell. The contact roll preceding the anodizing cell introduces the anodizing current and the contact roll following the plating cell introduces the plating current to the web.

FIG. 14*d* is similar to FIG. 14*b* wherein the contact cell and the plating cell are combined into the same cell.

In FIG. 14*e* the aluminum web is anodized by passing first through a contact cell and then through an anodizing cell. The anodized web is then passed through a plating cell and plating current is introduced to the web via an electrically conductive contact roll in contact with the web after it leaves the plating cell. The process illustrated by FIG. 14*e* is initiated with bare aluminum in the same manner as described for the embodiment shown in FIG. 14*b*.

The following examples are intended to further illustrate the present invention without limiting same in any manner.

Chromium and copper powders are formed by electroplating onto an anodized aluminum surface forming discrete metal particles. Cleaned aluminum plaques are anodized in an electrolyte containing 280 grams of sulfuric acid per liter of water. Anodizing is carried out at a temperature of 40° C with a current density of 30 amps per square foot for a period of approximately 54 seconds.

Following the formation of the anodic oxide layer, having an average pore diameter of about 100 Angstroms, chromium plating is carried out in an electrolyte containing 250 grams of chromic acid per liter of water and 2.5 grams of sulfuric acid per liter of water. Plating is carried out at a temperature of 40°–45° C for plating times between 10 and 120 seconds at a current density of 125 to 1000 amps per sq. ft. Copper plating is carried out in an analogous fashion.

Following plating, the anodized and plated plaques are immersed at room temperature in a bath containing 8 ounces of sodium hydroxide per gallon. After the oxide layer is removed the stripped aluminum plaques are withdrawn from the bath leaving the liberated metal particles supsended in the bath. The powders are recovered by centrifuging, washing and drying. Chromium powders are formed with particle sizes of 200 to 10,000 Angstroms and copper powders are formed with particle sizes of 100 to 10,000 Angstroms.

What is claimed is:

1. Process for making metal powders which comprises:

a. electrolytically depositing discrete metal particles in the pores of a porous surface of an anodized aluminum article; and thereafter b. liberating the metal particles from said pores by contacting the article from (a) with a substance that will attack the porous oxide surface but not the metal particles.

2. Process of claim 1 wherein said anodized aluminum article is in the form of a web and said depositing and said liberating are carried out continuously.

3. Process of claim 2 wherein said aluminum oxide web is continuously anodized in an anodizing cell to form a porous anodic surface prior to the electrolytic depositing step.

4. Process of claim 3 wherein said aluminum web is anodized by introducing anodizing direct current into the aluminum in a cathodic contact cell, said aluminum having an anodized oxide coating formed thereon before entering said cell, said metal particles being deposited in said pores in said contact cell.

5. Process of claim 3 wherein the aluminum web is anodized a second time after liberating the metal particles and the process is repeated.

* * * * *